United States Patent [19]

Carter

[11] 4,454,985

[45] Jun. 19, 1984

[54] DEVICE FOR CLAMPING RAILS TO TIES

[76] Inventor: Joseph H. Carter, 1120 Mayfair Pl., Rockford, Ill. 61103

[21] Appl. No.: 297,049

[22] Filed: Aug. 27, 1981

[51] Int. Cl.[3] ..... E01B 9/30; E01B 9/48; E01B 21/04

[52] U.S. Cl. ..... 238/270; 238/217; 238/283; 238/349; 238/353; 238/362

[58] Field of Search ..... 238/265, 270, 271, 269, 238/281, 282, 283, 285, 298, 349, 351, 362, 382, 217, 352, 353, 354

[56] References Cited

U.S. PATENT DOCUMENTS

| | | | |
|---|---|---|---|
| 349,913 | 9/1886 | Tozer | 238/298 |
| 1,010,601 | 12/1911 | Dillon | 238/265 X |
| 1,032,198 | 7/1912 | Flood | 238/265 X |
| 1,155,658 | 10/1915 | How | 238/265 |
| 1,229,926 | 6/1917 | Forbes et al. | 238/362 X |
| 1,346,965 | 7/1920 | Kehn | 238/353 |
| 1,830,304 | 11/1931 | Von Dorn | 238/351 |
| 1,971,927 | 8/1934 | Willard | 238/349 X |
| 3,442,452 | 5/1969 | Harmsen | 238/349 X |
| 3,664,584 | 5/1972 | Novotny | 238/349 |
| 3,700,167 | 10/1972 | Jennings et al. | 238/349 |
| 3,945,566 | 3/1976 | Bush | 238/349 |
| 3,957,201 | 5/1976 | Johnson et al. | 238/298 |
| 4,054,247 | 10/1977 | Duchemin | 238/349 |
| 4,066,212 | 1/1978 | Sonneville | 238/349 |
| 4,284,238 | 8/1981 | Veroef | 238/351 |

FOREIGN PATENT DOCUMENTS

| | | | |
|---|---|---|---|
| 186335 | 11/1963 | Sweden | 238/349 |
| 712472 | 1/1980 | U.S.S.R. | 238/283 |

*Primary Examiner*—Robert B. Reeves
*Assistant Examiner*—Howard Beltran
*Attorney, Agent, or Firm*—Leydig, Voit, Osann, Mayer & Holt, Ltd.

[57] ABSTRACT

A device for clamping a railroad rail to a concrete tie includes a hollow vertical member which projects down into the tie alongside the rail and has an interior bearing surface which projects downwardly and inwardly toward the centerline of the tie. A generally C-shaped spring is disposed with its upper end abutting an upwardly facing surface on the rail and its center portion projecting down into the hollow member, the lower end of the spring abutting the bearing surface. A wedge acts between another interior bearing surface on the member and the center portion of the spring to flex the latter somewhat and cause the spring to clamp the rail tightly against the tie.

5 Claims, 4 Drawing Figures

10
11
2
12
13
14
15
16
17
18
19
20
21
22
23
24
26
27
28
29
30
31
32
33
34
35
36
37
38
39
40
41
43

DEVICE FOR CLAMPING RAILS TO TIES

BACKGROUND OF THE INVENTION

This invention relates to a device for clamping a railroad rail to a tie. Apart from conventional spikes, various devices for clamping rails to ties have been proposed but these have had any of a number of drawbacks. Among these drawbacks are that the clamping devices are relatively difficult to assemble in the field by installing and maintenance crews, that they may be disassembled fairly easily by vandals and other unauthorized persons, and that they are comparatively expensive.

SUMMARY OF THE INVENTION

The general object of the invention is to provide a new and improved clamping device which is virtually tamper-proof when installed, which is a precision assembly for use with high-speed trains while requiring no special fitting operations during either installation or maintenance, and which is comparatively easy and inexpensive to manufacture.

A more detailed object is to form the clamping device from a hollow generally vertical member which projects down into the tie alongside the rail and which has an interior inwardly projecting bearing surface and to use a generally C-shaped spring with its upper end bearing on an upwardly facing surface of the tie and with the center portion of the spring projecting down into the hollow member so that the lower end of the spring abuts the bearing surface while a wedge acting between a wall of the hollow member and the center portion of the spring flexes the latter and causes the spring to clamp the rail to the tie.

Another object is to form the clamping device in a novel manner so that it cushions the rail and electrically insulates the rail from the tie.

Still a further object is to form a plurality of hollow members as a single part whereby the part includes hollow members for all of the devices used to clamp a rail to each tie.

The invention also resides in the details of construction of the clamping device and especially in the aspects which make the device particularly suitable for use in connection with a cast concrete tie.

DETAILED DESCRIPTION OF THE PREFERRED EMBODIMENTS

Figure 1:
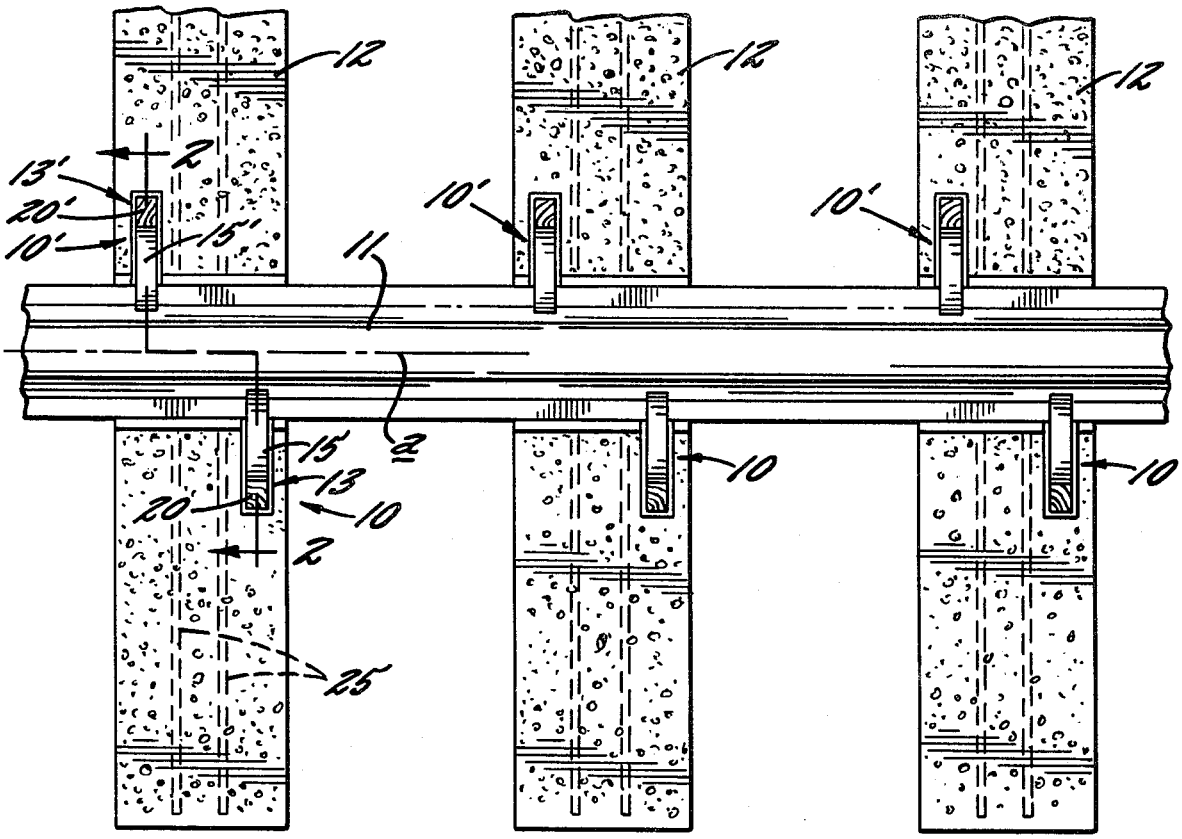
FIG. 1 is a fragmentary plan view of a rail and a plurality of ties with the rail being clamped to the ties by clamping devices embodying the present invention.

Although the clamping device 10 of the present invention is applicable for clamping a railroad rail 11 to ties made of various materials such as wood, it is shown in the drawings for purposes of illustration as used in connection with cast reinforced concrete ties 12. In the drawings, only one rail and three ties are shown but it will be understood that, as is conventional, the rails are mounted in pairs and the number of ties is correlated to the length of the railroad track. Also, as is customary, two clamping devices 10 and 10' are used for each rail and tie combination with one clamping device on each side of the rail although in some applications it may be desirable to use two such devices on each side of the rail.

Figure 2:
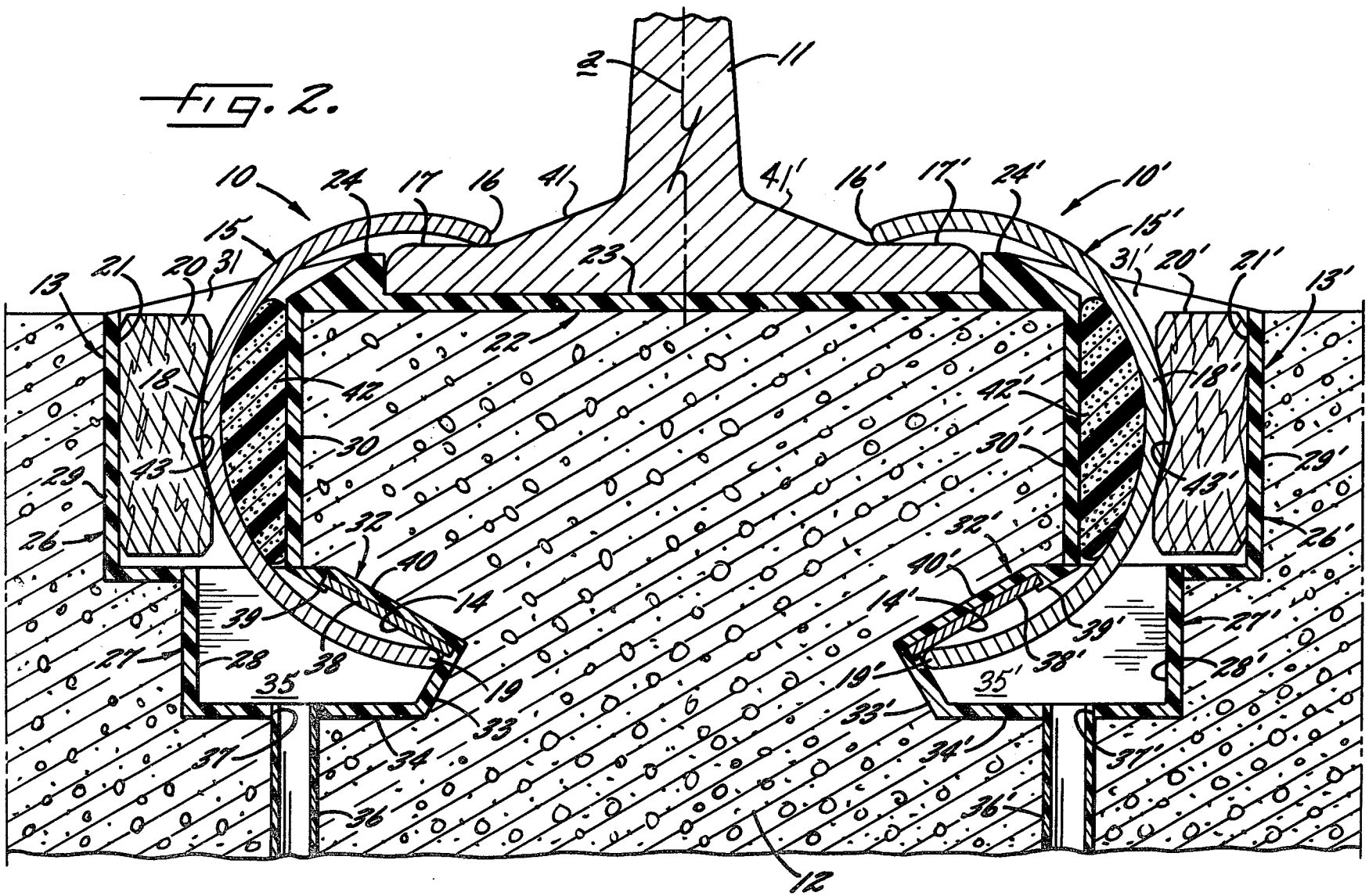
FIG. 2 is an enlarged fragmentary sectional view taken along the line 2—2 in FIG. 1.

The present invention contemplates the provision of a novel clamping device 10 which is virtually tamper-proof and which is made as a precision assembly so that there are no special fitting operations and the like that need to be performed by installing and maintenance crews and nevertheless is suitable for use with the tracks of high-speed trains. In general, the foregoing is achieved by forming the device with a generally vertical hollow member 13 which projects down into the tie alongside the rail and which has an interior inwardly projecting bearing surface 14 (FIG. 2). A generally C-shaped spring 15 is disposed with one end 16 abutting an upwardly facing surface 17 on the rail 11 and the center portion 18 of the spring projects into the member 13 with the other end 19 of the spring abutting the bearing surface 14. A wedge 20 acts between another interior bearing surface 21 on the member and the center portion of the spring to cause the latter to flex and clamp the rail tightly against the tie 12.

Figure 4:
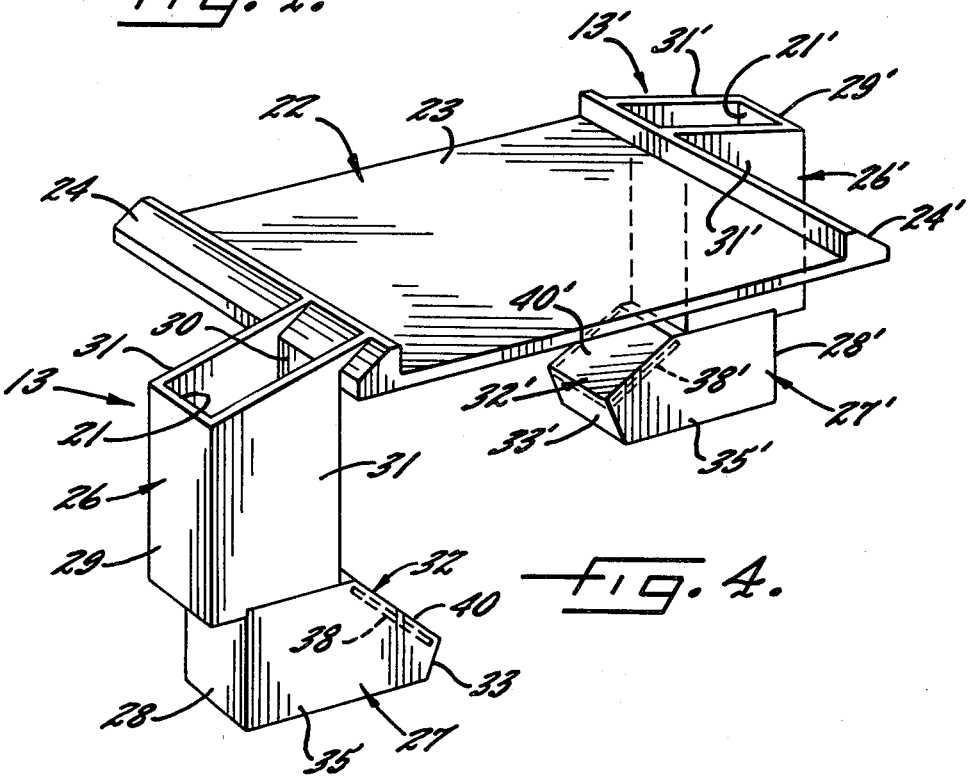
FIG. 4 is a perspective view of a part which includes the hollow members for two clamping devices.

In another of its aspects, the hollow members of a plurality of clamping devices are made as a unitary part 22 (FIG. 4) with clamping devices on both sides of the rail 11. While there may be two or more clamping devices on each side of the rail, in the illustrated form, the part 22 includes the hollow members 13 and 13' for two clamping devices 10 and 10' with one on each side of the rail. The two hollow members are joined by a flat horizontal plate portion 23 which underlies the rail 11 and is clamped with the rail to the upper side of the tie 12. Upstanding flanges 24 and 24' are formed on the plate portion and, as shown in FIG. 2, are spaced apart a distance equal to the width of the bottom of the rail so that the flanges accurately position the rail relative to the tie.

In the form illustrated in the drawings, the part 22 is molded of a suitable rigid plastic material such as polyvinyl chloride and, along with the reinforcing rods 25 (FIG. 1), is placed in the mold for a tie 12 before the concrete from which the tie is cast is poured so that the part and the rods are rigidly cast in place in the tie . The hollow members 13 and 13' are generally L-shaped with the upper portions 26 and 26' being vertical and rectangular in cross section and the lower portions 27 and 27' having their rear walls 28 and 28' offset inwardly toward the centerline a (FIG. 2) of the rail 11 from the back walls 29 and 29' of the upper portions. The lower portions also project also project inwardly beyond upper portions. With this arrangement, the part is molded in three sections with the plate 23, the flanges 24 and 24' and the upper portions 26 and 26' being one section and the two lower portions 27 and 27' being the other sections. Once the sections are molded, the lower portions are cemented or otherwise bonded to their respective upper portions although the upper and lower portions may be placed separately in the mold for casting the tie.

In the case of the clamping device 10, the hollow member 13 is disposed alongside the flange 24 with its front or inner wall 30 depending from the outer edge of the flange, the upper portion also including spaced side walls 31 joining the outer and inner walls 29 and 30. In addition to the rear wall 28, the lower portion 27 of the hollow member 13 includes a wall 32 which projects downwardly and inwardly from the lower end of the wall 30 and, as will be explained later more in detail, provides the bearing surface 14 for the lower end 19 of the spring 15. Connected to the wall 32 is a short inner wall 33 which herein is inclined outwardly and a bottom wall 34 spans the walls 28 and 33, the sides of the lower portion 27 being enclosed by side walls 35. If desired, a drain tube 36 may be inserted in a hole 37 in the bottom wall 34 and cast in place with the part 27 so that the tube extends down through the bottom of the tie 12.

To provide a hard bearing surface 14 which will withstand the sliding and the force of the spring end 19, the inclined wall 32 of the lower portion 27 includes a metal plate 38 which is set in place during the molding of the lower portion and which has its inner surface exposed to the bearing surface. As molded, the lower portion 27 provides a seal 39 along the margins of the plate and the plastic material of the lower portion covers the outer surface of the plate as indicated at 40 in FIG. 2 to electrically insulate the plate from the concrete which forms the body of the tie 12. Also, this insulates the plate for sound and vibration.

As stated earlier, the spring 15 is generally C-shaped and may be composed of a number of similar parts disposed side by side or may be made as a single member as illustrated in the drawings. The width of the spring is approximately equal to the distance between the side walls 31 of the upper portion 26 of the hollow member 13 so that the spring may be inserted in the hollow member and essentially spans these side walls. Herein, the spring is arcuate and constitutes about five-eighths of a circle.

Figure 3:
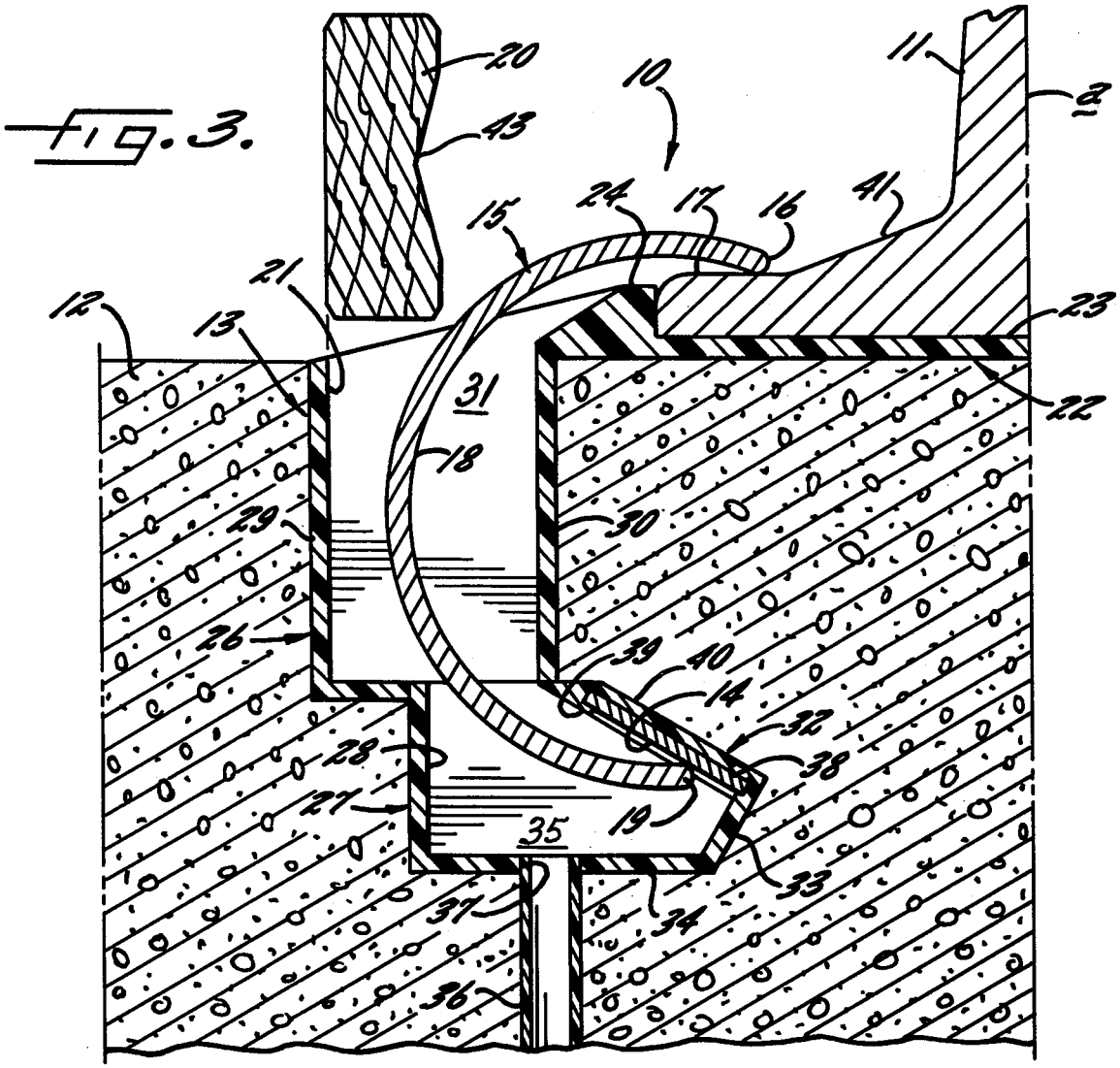
FIG. 3 is a view similar to FIG. 2 but showing the parts in the process of assembly.

In assembling the clamping device 10 to clamp the rail 11 to a tie 12 (see FIG. 3), the lower end 19 and the center portion 18 of the spring are inserted in the hollow member 13 and the spring is positioned with its upper end 16 at the intersection of the horizontal marginal surface 17 of the rail and the adjacent inclined surface 41. If desired, a complementally shaped piece 42 (FIG. 2) of a soft flexible plastic material such as styrene foam may be placed between the center portion of the spring and the inner wall 30 of the hollow member to seal the space between the two. In this position, the lower end 19 of the spring abuts the plate 38 near the outer edge of the latter. Next, the wedge 20 is forced into the hollow member between the bearing surface 21 and the center portion 18 of the spring. Herein, the wedge is a rectangular block of wood and, as the wedge is inserted, it causes the spring to resiliently open somewhat and cams the lower end 19 of the spring down toward the inner end of the plate 38 as shown in FIG. 2. As a result, the spring exerts a compressive clamping force between the rail 11 and the plate 38 to clamp the rail on the plate portion 23 of the part 22 and hence onto the tie 12. The clamping force is determined by the thickness of the spring or the width of same, or the amount of flexure exerted by the wedge 20. A force of about 100 pounds usually would be suitable.

Preferably, a horizontal V-shaped notch 43 is formed at the middle of the inner side of the wedge and the notch receives the center portion 18 of the spring 15. As a result, the notch inhibits the removal of the wedge and the spring by vandals and the like. For maintenance purposes, however, the clamping device 10 may be disassembled by drilling a hole in the top of the wedge, threading a hook or the like (not shown) into the hole, and lifting and hook to pull the wedge out of the hollow member 13. When the clamping device is reassembled, the wedge is inverted so that the hole faces down and is not accessible to vandals. If desired, once the clamping device 10 is assembled, the upper end of the hollow member 13 may be sealed with a wax, grease, caulking compound or other sealant (not shown) to keep water and other foreign matter out of the hollow member. Also, one or more shims (not shown) may be inserted between the wedge 20 and the bearing surface 21 so that the spring end 16 rides up on the inclined surface 41 of the rail and increases the clamping force.

The other clamping device 10' is similar to the clamping device 10 and the corresponding parts are indicated by the same but primed reference numerals.

It will be apparent that the clamping system using the clamping devices 10 as described above constitute precision assemblies and produce the same clamping force of the rail 11 to the ties 12 without special attention by installing and maintenance crews. Moreover, the system is especially suitable for high-speed passenger trains which travel several hundred miles per hour and heavy-duty freight trains which can safely travel at much higher speeds than customarily in use. Thus, the plate portion 23 of the part 22 serves both as a cushion for the rail and as an insulator between the rail and the ties. Further, as explained above, the bearing plate 38 is insulated from the tie for sound, vibration and electrical grounding. In addition, the entire assembly controls the effects between the rail and the ties as may be caused by acceleration and deacceleration of the locomotive riding on the rails. With this assembly, vibrations have little or no effect on the clamping force. Also, the system realistically inhibits tampering with the clamping devices by vandals and the like and, while achieving all of the foregoing, is comparatively inexpensive to manufacture.

I claim:

1. A device for clamping a rail to a cast concrete tie, said device comprising, a unitary member adapted to be in place relative to the tie as the tie is cast thereby to be cast rigidly with the tie, said member including:

(a) a flat plate portion disposed on top of the tie and underlying the rail, (b) first and second flanges projecting upwardly respectively from the ends of said plate portion and spaced apart a distance to receive and locate the rail, (c) a first elongated hollow portion disposed alongside said first flange and projecting generally vertically down into the tie, said hollow portion having an open upper end and having a first internal and generally vertical bearing surface on the side spaced outwardly from said first flange and a second internal bearing surface spaced below and inwardly of said first bearing surface, said second bearing surface being inclined to project downwardly and inwardly, and (d) a second and similar hollow portion disposed alongside said second flange and projecting down into the tie, said second hollow portion also having an open upper end and having third and fourth bearing surfaces similar respectively to the first and second bearing surfaces of said first hollow portion, a first generally C-shaped spring having one end abutting the upper surface of the edge portion of the rail adjacent said first hollow portion, said spring projecting into said first hollow portion through the upper end thereof with the center portion of the spring being spaced inwardly from said first bearing surface and the other end of the spring abutting said second bearing surface, a first wedge disposed between said center portion of said spring and said first bearing surface to force the spring inwardly and to force said other end of the spring downwardly along said second bearing surface whereby the spring firmly clamps the rail to the tie, a second and similar spring and similarly disposed relative to said second hollow portion and the other edge portion of the rail, and second and similar wedge similarly disposed in said second hollow portion and similarly acting on said second spring whereby the latter also clamps the rail to the tie.

2. A device as defined in claim 1 in which all of said member except said second and fourth bearing surfaces is molded from a rigid plastic material, said second bearing surface being the inner surface of a first flat metal plate and said fourth bearing surface similarly being the inner surface of a second flat metal plate.

3. A device as defined in claim 2 in which all of the exterior of each of said plates is encased by the plastic material thereby to electrically insulate said plates, said springs and the rail from the tie.

4. A device as defined in claim 1 in which said first wedge is a rectangular block of wood inserted vertically endwise into said first hollow portion between said first bearing surface and said first spring and said second wedge is a similar block similarly inserted in said second hollow portion between said third bearing surface and said second spring.

5. A device as defined in claim 4 in which the sides of said blocks facing said springs each are formed with a horizontal notch receiving the center portion of the associated one of said springs.

* * * * *